US007891787B2

(12) United States Patent
Kumagai et al.

(10) Patent No.: US 7,891,787 B2
(45) Date of Patent: Feb. 22, 2011

(54) LIQUID FEEDING DEVICE AND LIQUID EJECTING APPARATUS

(75) Inventors: Toshio Kumagai, Shiojri (JP); Tsuyoshi Otani, Chino (JP)

(73) Assignee: Seiko Epson Corporation, Tokyo (JP)

( * ) Notice: Subject to any disclaimer, the term of this patent is extended or adjusted under 35 U.S.C. 154(b) by 627 days.

(21) Appl. No.: 11/939,213

(22) Filed: Nov. 13, 2007

(65) Prior Publication Data

US 2008/0111869 A1 May 15, 2008

(30) Foreign Application Priority Data

Nov. 13, 2006 (JP) ..... 2006-306443

(51) Int. Cl.
*B41J 2/175* (2006.01)

(52) U.S. Cl. ..... 347/85

(58) Field of Classification Search ..... 347/84–87, 347/36

See application file for complete search history.

(56) References Cited

U.S. PATENT DOCUMENTS 4,571,787 A 2/1986 Furutsu
6,505,924 B2 * 1/2003 Shimizu ..... 347/86
6,739,707 B2 * 5/2004 Shimizu et al. ..... 347/85
6,755,514 B2 * 6/2004 Koga ..... 347/85
6,923,535 B2 * 8/2005 Koga ..... 347/108
6,948,802 B2 * 9/2005 Koga ..... 347/85
7,063,409 B2 * 6/2006 Koga ..... 347/85
7,229,163 B2 * 6/2007 Shimizu et al. ..... 347/85

FOREIGN PATENT DOCUMENTS

JP 60-107410 U 7/1985
JP 60-177050 U 11/1985
JP 6-000746 U 1/1994
JP 2001-171145 A 6/2001
JP 2002-200768 A 7/2002
JP 2003-175589 A 6/2003
JP 2003175589 A * 6/2003
JP 2004-058452 A 2/2004

* cited by examiner

*Primary Examiner*—An H Do
(74) *Attorney, Agent, or Firm*—Sughrue Mion, PLLC

(57) ABSTRACT

A liquid feeding device includes: a flexible tube to be arranged so as to be curved at the midsection thereof for feeding liquid to a liquid ejecting head for ejecting the liquid toward a target; a resilient longitudinally extending member to be arranged so as to extend along the tube; and a binding member for binding the longitudinally extending member with the tube at a distance from each other. The binding member is fixed to the tube and slidably supports the longitudinally extending member.

5 Claims, 3 Drawing Sheets

LIQUID FEEDING DEVICE AND LIQUID EJECTING APPARATUS

BACKGROUND

1. Technical Field

The present invention relates to a liquid ejecting apparatus such as an ink jet printer and a liquid feeding device provided on the liquid ejecting apparatus.

2. Related Art

An ink jet printer as one of the liquid ejecting apparatus (hereinafter, referred to as "printer") includes a recording head (liquid ejecting head) for ejecting ink (liquid) fed from an ink cartridge through a flexible tube, and is configured to carry out a print job by ejecting ink from nozzles provided on the recording head to a recording medium (target).

The recording head of the printer as described above is mounted on a reciprocating carriage in many cases. Normally, the tube is laid in the interior of the printer in the shape of a curve with one end thereof fixed to the ink cartridge, and the other end thereof fixed to the recording head (for example, JP-A-2001-171145).

In other words, in the printer disclosed in JP-A-2001-171145, the tube, a sponge layer (longitudinally extending member), a stainless panel (longitudinally extending member) having resiliency, and a flexible flat cable (longitudinally extending member) are laminated in sequence. These members are bound altogether in a laminated state with a binding member and laid in the shape of a curve.

In the printer in JP-A-2001-171145, since the tube, the sponge layer, the stainless panel, and the flexible flat cable are laid in the shape of a curve in the laminated state, the radius of curvature in the curved portions thereof differ from each other. Therefore, when the carriage is reciprocated, the tube is in friction with the binding member or the sponge layer in the curved portion, and hence there arises a problem such that chips of the tube or the sponge layer may be generated.

SUMMARY

An advantage of some aspects of the invention is that there is provided a liquid feeding device and a liquid ejecting apparatus in which a curved portion of a flexible tube for feeding liquid to a liquid ejecting head is prevented from generating chips by being in friction with a longitudinally extending member arranged so as to extend along the tube and a binding member for binding the longitudinally extending member with the tube.

According to an aspect of the invention, a liquid feeding device includes a flexible tube arranged so as to be curved at the midsection thereof for feeding liquid to a liquid ejecting head that ejects the liquid toward a target; a resilient longitudinally extending member arranged so as to extend along the tube; and a binding member for binding the longitudinally extending member with the tube at a distance from each other. The binding member is fixed to the tube and slidably supports the longitudinally extending member.

According to the aspect of the invention, the binding member is fixed to the tube while maintaining a distance between the longitudinally extending member and the tube, and slidably supports the longitudinally extending member. Therefore, the curved portion of the tube is prevented from being in friction with the binding member and the longitudinally extending member even when the shape of the tube and the longitudinally extending member is changed because the curved portion of the tube and the longitudinally extending member is moved along with the movement of the liquid ejecting head. Therefore, the curved portion of the flexible tube for feeding liquid to the liquid ejecting head is prevented from generating chips by being in friction with the longitudinally extending member arranged so as to extend along the tube and the binding member for binding the longitudinally extending member and the tube.

In the liquid feeding device according to the aspect of the invention, the binding member is composed of a material having an abrasion resistance higher than a material which constitutes the tube.

In this configuration, durability of the binding member is improved.

In the liquid feeding device according to the aspect of the invention, a plurality of the binding members are provided along the longitudinal direction of the tube.

In this configuration, the longitudinally extending member and the tube may be stably bound with respect to each other while maintaining a distance between the longitudinally extending member and the tube.

In the liquid feeding device according to the aspect of the invention, the binding members are arranged at regular intervals.

In this configuration, the longitudinally extending member and the tube are bound stably in a balanced manner wile maintaining a distance between the longitudinally extending member and the tube.

A liquid ejecting apparatus according to another aspect of the invention includes a liquid ejecting head for ejecting liquid toward a target, and a liquid feeding unit for feeding the liquid to the liquid ejecting head, and the liquid feeding unit is composed of a liquid feeding device in the configuration described above.

In this configuration, the curved portion of the tube is prevented from being in friction with the binding members and the longitudinally extending member even when the shape of the tube and the longitudinally extending member is changed because the curved portions of the tube and the longitudinally extending member are moved along with the movement of the liquid ejecting head. Therefore, the curved portion of the flexible tube for feeding liquid to the liquid ejecting head is prevented from generating chips by being in friction with the longitudinally extending member arranged so as to extend along the tube and the binding member for binding the longitudinally extending member and the tube.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
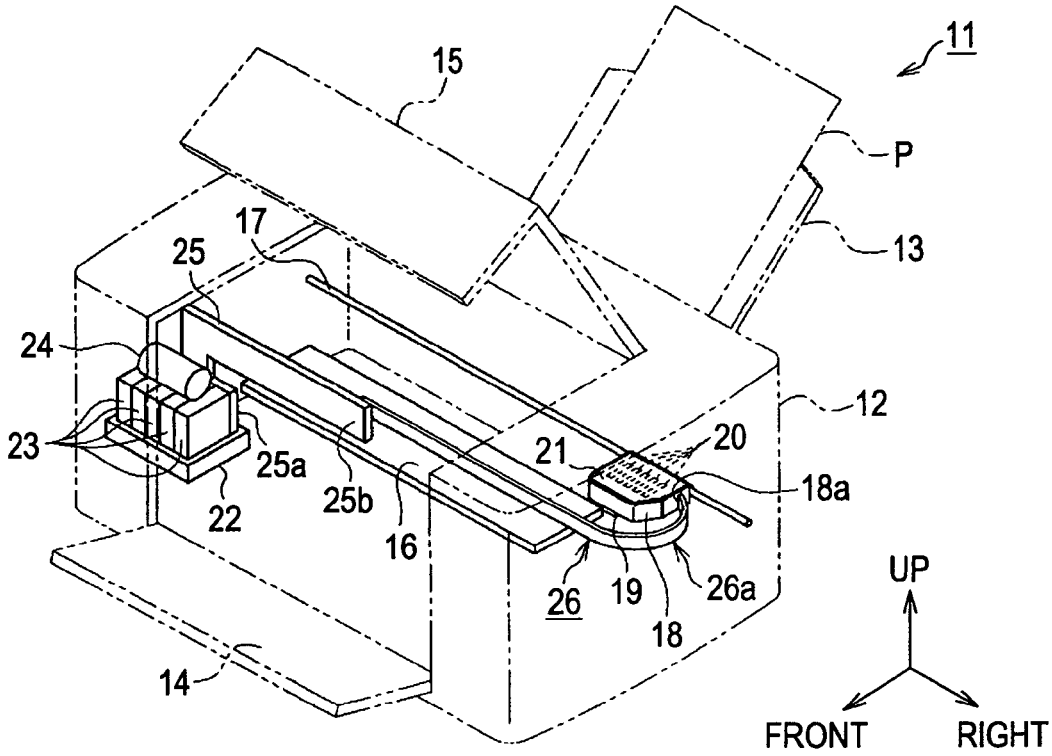
FIG. 1 is a schematic perspective view of an ink jet printer according to an embodiment of the invention.

Referring now to the drawings, an embodiment in which the invention is embodied on an ink jet printer as a liquid ejecting apparatus will be described. In the description shown below, the term "fore-and-aft direction", "vertical direction" and "lateral direction" correspond to "fore-and-aft direction", "vertical direction" and "lateral direction" on the basis of the directions indicated in FIG. 1 unless otherwise specifically noted.

As shown in FIG. 1, an ink jet printer 11 as the liquid ejecting apparatus according to the embodiment includes a frame 12 formed substantially into a parallelepiped shape. Provided behind the frame 12 is a paper feed tray 13, and provided in front of the frame 12 is a paper discharge tray 14. Provided on top of the frame 12 is a printer cover 15. The paper discharge tray 14 and the printer cover 15 are respectively adapted to be folded and stored with respect to the frame 12 by hinge mechanisms, not shown.

A platen 16 is provided so as to extend in the lateral direction in the lower portion in the frame 12. The platen 16 is a supporting base for supporting a recording paper P as a target, and is adapted to discharge the recording paper P fed from the paper feed tray 13 from the paper discharge tray 14 to the outside of the frame 12 by a paper feed mechanism, not shown.

A guide shaft 17 extending in the lateral direction is provided in the frame 12 above the platen 16. The guide shaft 17 is supported so as to allow a carriage 18 to reciprocate along the guide shaft 17. A drive pulley and a driven pulley, not shown, are rotatably supported at positions corresponding to the both ends of the guide shaft 17 on the inner surface of the rear wall of the frame 12.

An output shaft of a carriage motor (not shown), which serves as a drive source when reciprocating the carriage 18, is connected to the drive pulley, and an endless timing belt (not shown) connected to the carriage 18 is wound between these both pulleys. Therefore, the carriage 18 is adapted to be able to move in the lateral direction via the endless timing belt by a drive force of the carriage motor while being guided by the guide shaft 17. A recording head 19 as the liquid ejecting head is provided on the lower surface of the carriage 18, and a plurality of nozzles (not shown) for ejecting ink as liquid fed to the recording head 19 are formed on the lower surface of the recording head 19.

The carriage 18 includes a storage section being depressed and opening on top, and a plurality (five in the embodiment) valve units 20 are stored therein. The valve unit 20 adjusts the pressure of ink stored temporarily therein and feeds the pressure-adjusted ink toward the recording head 19, and are connected to the respective nozzles of the recording head 19 via feed needles (not shown). A carriage cover 21 for closing the opening of the storage section is attached to the top of the carriage 18.

When a piezoelectric element, not shown, provided in the recording head 19 is driven, ink is ejected from the respective nozzles toward the recording paper P which arrives a position below the recording head 19, so that a print job is carried out.

A cartridge holder 22 is fixedly provided on the left end portion in the frame 12 at a position shifted toward the front from the center. A plurality of (five in the embodiment) ink cartridges 23, in which different colors of ink are stored, are detachably mounted onto the cartridge holder 22. From this point, the ink jet printer 11 in the embodiment is configured not as, so-called an "on-carriage type printer", in which the ink cartridge 23 moves together with the carriage 18, but as, so-called an "off-carriage type printer", in which the ink cartridges 23 do not move with the carriage 18 in the frame 12.

A pressure pump 24 is provided above the cartridge holder 22 in the frame 12, and a flow channel formed member 25 having a plurality of (five in the embodiment) liquid flow channels (not shown) to be connected respectively to the ink cartridges 23 is provided at a position behind the respective ink cartridges 23 on the cartridge holder 22. The flow channel formed member 25 is formed into a lateral L-shape extended exactly upward from the cartridge holder 22 and bent at a midsection toward the right at a right angle.

In other words, the flow channel formed member 25 includes a substantially square-plate-shaped mounting portion 25*a* to be mounted onto the cartridge holder 22, and an extending portion 25*b* formed integrally with the mounting portion 25*a* so as to extend from an upper end portion to a substantially center in the lateral direction in the frame 12. A plurality of (five in the embodiment) ink flow channels (not shown) are formed on the mounting portion 25*a* and the extending portion 25*b* of the flow channel formed member 25.

When the pressure pump 24 is driven, compressed air is pumped from the pressure pump 24 into the respective ink cartridges 23, so that ink packs stored in the respective ink cartridges 23 are crushed by the compressed air, whereby ink in the respective ink packs are pumped to the respective ink flow channels of the flow channel formed member 25.

Figure 2:
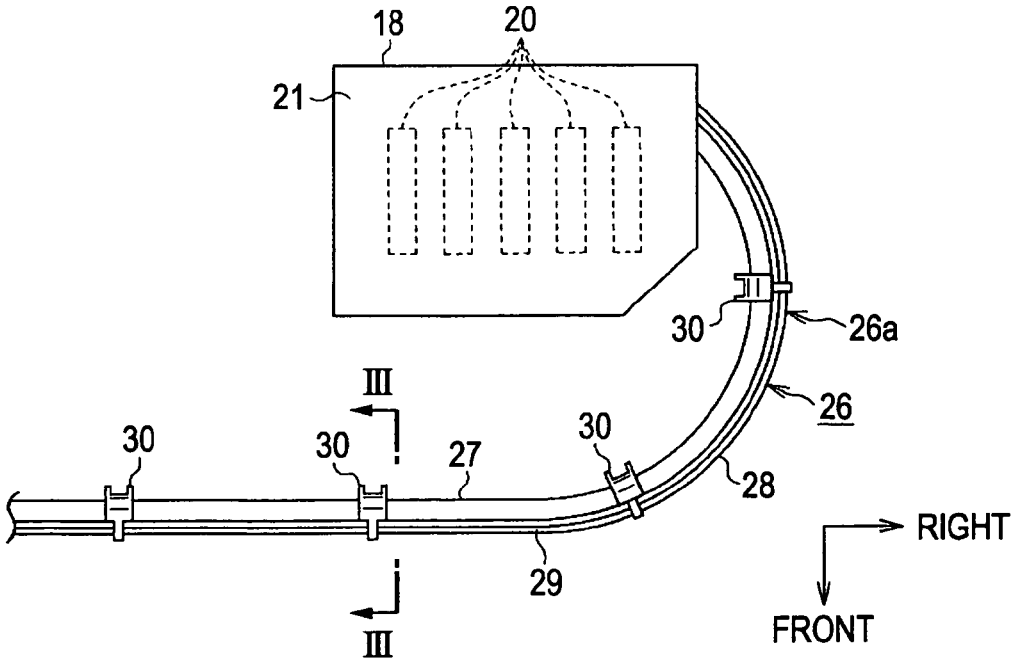
FIG. 2 is a plan view of a liquid feeding device of the ink jet printer in FIG. 1.

As shown in FIG. 1 and FIG. 2, the band-shaped proximal portion of a liquid feeding device 26 as a liquid feeding unit is connected to the distal portion of the extending portion 25*b* of the flow channel formed member 25, and the distal portion of the liquid feeding device 26 is inserted into the carriage 18 from an insertion hole 18*a* formed on the right side of the carriage 18 and supported thereby. In this case, the liquid feeding device 26 is laid therein with a curved portion 26*a* formed at the midsection thereof. The liquid feeding device 26 includes an ink feeding tube 27 as the flexible tube, and a band-shaped holding member 28 as the longitudinally extending member extending along the outside (front side) of the ink feeding tube 27 and having resiliency for holding the ink feeding tube 27.

The liquid feeding device 26 further includes a band-shaped flexible printed wiring board 29 as the resilient longitudinally extending member extending along the ink feeding tube 27 and being arranged between the ink feeding tube 27 and the holding member 28, and binding members 30 for binding the ink feeding tube 27, the holding member 28 and the flexible printed wiring board 29 in a state of being held at a distance from each other.

Figure 3:
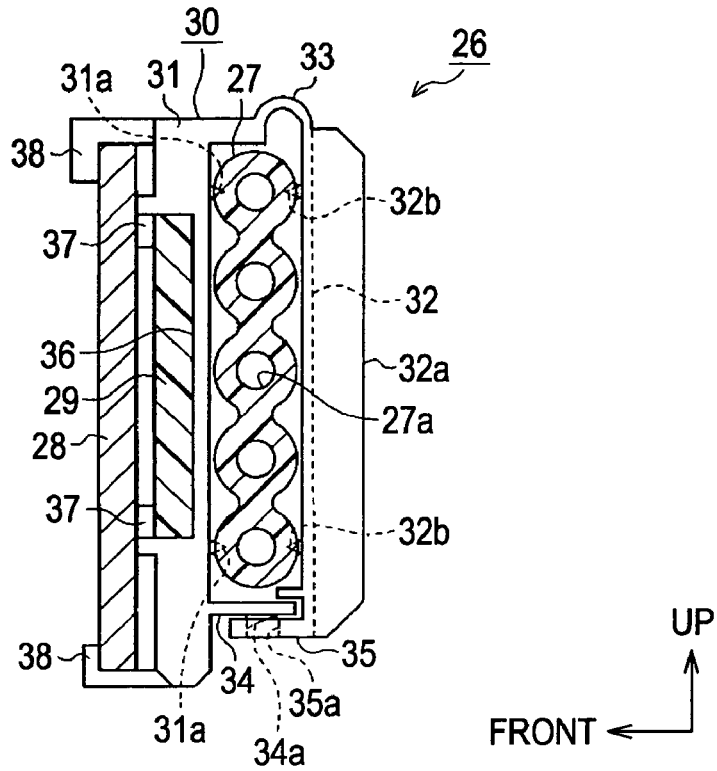
FIG. 3 is a cross-sectional view taken along the line III-III in FIG. 2.

As shown in FIG. 2 and FIG. 3, the ink feeding tube 27 is formed of elastomer such as rubber, and is configured by integrally forming a plurality of (five in the embodiment) tubes arranged in parallel in the vertical direction. Therefore, the ink feeding tube 27 includes five ink feeding channels 27*a*. The proximal portion of the ink feeding tube 27 is connected to the distal portion of the extending portion 25*b* of the flow channel formed member 25 so that the five ink flow channels (not shown) of the extending portion 25*b* communicate respectively with the five ink feeding channels 27*a* of the ink feeding tube 27.

On the other hand, the distal portion of the ink feeding tube 27 is connected to the five valve units 20 in the carriage 18, so that the valve units 20 communicate respectively with respect to the five ink feeding channels 27*a* of the ink feeding tube 27. The ink feeding channels 27*a* of the ink feeding tube 27 communicate respectively with the recording head 19 via the valve units 20.

Therefore, the ink in the ink cartridges 23 is fed from the corresponding ink flow channels of the flow channel formed member 25 to the recording head 19 via the respective ink feeding channels 27*a* of the ink feeding tube 27 and the valve units 20 by a pressurizing force of a compressed air fed form the pressure pump 24.

The holding member 28 is formed of metal. However, it may be formed of synthetic resin having resiliency. When the holding member 28 is formed of synthetic resin, it is preferable to employ the one having heat-resistant property considering that the ambient temperature may increase to a high temperature (about 60° C. at maximum) due to the place of storage or the environment during transportation. The synthetic resin having the heat-resistant property includes polyethylene terephthalate having high heat-resistant property. Then, the proximal portion of the holding member 28 is fixed to the distal portion of the extending portion 25*b* of the flow channel formed member 25 and the distal portion thereof is fixed to the interior of the carriage 18.

The proximal portion of the flexible printed wiring board 29 is electrically connected to a control unit, not shown, in the frame 12 and the distal portion thereof is electrically connected to a piezoelectric element, not shown, provided in the recording head 19. Therefore, with a driving current fed from the control unit to the piezoelectric element via the flexible printed wiring board 29, the piezoelectric element is driven by the control unit.

A plurality of the binding members 30 are disposed at regular intervals (for example, every 5 to 10 cm) along the longitudinal direction of the ink feeding tube 27 (liquid feeding device 26), and is formed of a material having a higher abrasion resistance than elastomer which constitutes the ink feeding tube 27. Such the material includes synthetic resin and metal and, in the embodiment, polyamide (nylon) is employed as a material which constitutes the binding members 30 considering its high abrasion resistance, high machining flexibility and light weight in comparison with metal.

Figure 4:
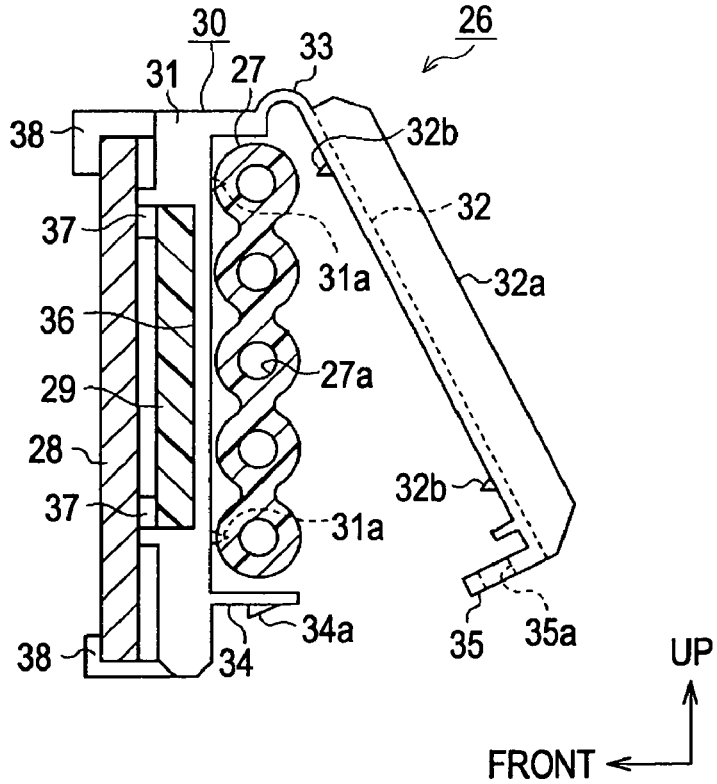
FIG. 4 is a cross-sectional view illustrating a binding member in FIG. 3 in a state in which a swinging portion is swung in the direction away from a body member.

As shown in FIG. 3 and FIG. 4, the binding member 30 includes a plate-shaped body portion 31 elongated in the vertical direction, a plate-shaped swingable portion 32 elongated in the vertical direction and arranged so as to oppose the body portion 31 on the back side of the body portion 31, and a hinge portion 33 for connecting the body portion 31 and the swingable portion 32 at the upper end portions thereof. Provided at the both left and right edges of the swingable portion 32 are ribs 32*a* respectively over the entire ranges in the vertical direction. The swingable portion 32 is swingable toward and away from the body portion 31 about the hinge portion 33.

A substantially square-plate-shaped supporting strip 34 protrudes from the lower end portion of the body portion 31 toward the rear, and a wedge-shaped engaging strip 34*a* is provided at the center portion of the lower surface of the supporting strip 34. On the other hand, a substantially square-plate-shaped engaged member 34 is provided at the lower end portion of the swingable portion 32 so as to protrude toward the front, and an engaging hole 35*a* is formed at the center portion of the engaged member 35 so as to penetrate therethrough in the vertical direction.

Then, when the swingable portion 32 is swung toward the body portion 31, the engaging strip 34*a* and the engaging hole 35*a* engage with each other, and the swinging motion of the swingable portion 32 is locked. The body portion 31 is formed with fixing strips 31*a* pointed at the distal ends thereof so as to protrude from the both upper and lower end portions of the rear surface thereof and the swingable portion 32 is formed with fixing strips 32*b* which are similar to the fixing strips 31*a* on the front surface thereof so as to protrude from positions opposing the both fixing strips 31*a*.

When the swingable portion 32 is swung toward the body portion 31 in a state in which the ink feeding tube 27 is arranged on the rear surface of the body portion 31 to engage the engaging strip 34*a* and the engaging hole 35*a*, the swingable portion 32 is locked in a state in which the both fixing strips 31*a* and the both fixing strips 32*b* are dug into the ink feeding tube 27. In other words, the binding members 30 are fixed to the ink feeding tube 27 by locking the swingable portion 32 so as not to be capable of swinging in a state of pinching the ink feeding tube 27 between the body portion 31 and the swingable portion 32. Therefore, the binding members 30 are attachable to and detachable from the ink feeding tube 27.

The body portion 31 is formed with a supporting recess 36 opening on both left and right sides and the front side for supporting the flexible printed wiring board 29 at the center portion of the front surface thereof. The supporting recess 36 is formed with a pair of limiting projections 37 for limiting the movement of the flexible printed wiring board 29 in the fore-and-aft direction on the both upper and lower sides at the front end portion thereof. Therefore, in a state in which the flexible printed wiring board 29 is supported by the supporting recess 36, the flexible printed wiring board 29 is limited in movement in the fore-and-aft direction and is allowed in sliding motion in the lateral direction (longitudinal direction).

The body portion 31 is formed with a pair of L-shaped clutching strips 38 so as to protrude from the upper and lower ends of the front surface thereof, so that the holding member 28 is supported from both sides thereof by the clutching strip 38. Therefore, in a state in which the holding member 28 is supported by the clutching strips 38, the holding member 28 is limited in movement in the fore-and-aft direction and is allowed in sliding motion in the lateral direction (longitudinal direction). In this case, the rear surface of the holding member 28 is in sliding contact with the front surface of the limiting projections 37.

In this manner, the binding members 30 are fixed to the ink feeding tube 27 so as to isolate the ink feeding tube 27, the holding member 28 and the flexible printed wiring board 29 by the body portion 31, and support the holding member 28 and the flexible printed wiring board 29 in a state of being apart from each other by the both limiting projections 37.

Subsequently, an operation of the liquid feeding device 26 will be described.

Figure 5:
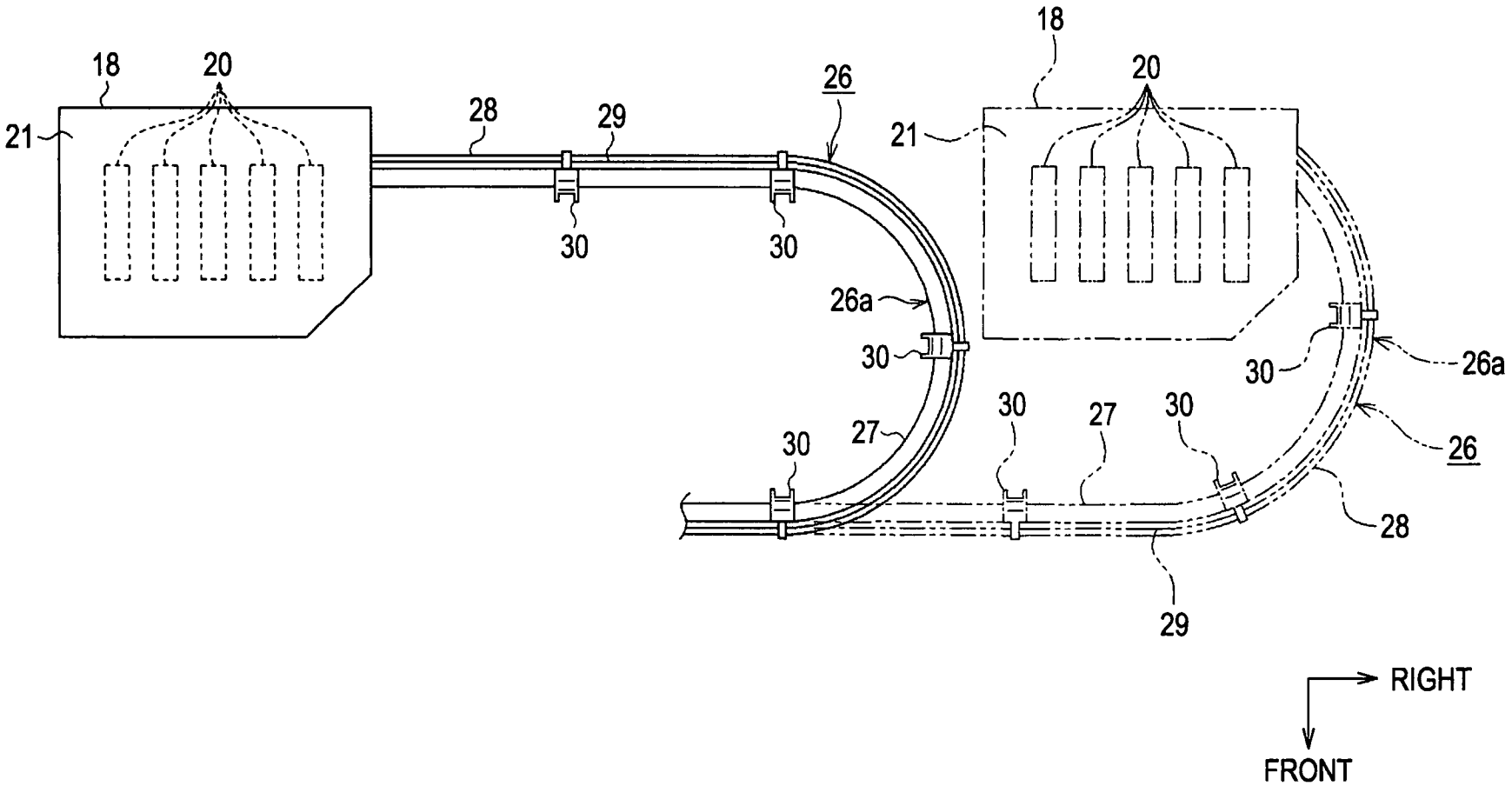
FIG. 5 is a plan view showing an operation of the liquid feeding device.

As shown in FIG. 5, when the carriage 18 is moved in the lateral direction for carrying out a print job, the curved portion 26*a* of the liquid feeding device 26 moves along the movement of the carriage 18, and the liquid feeding device 26 changes in form. At this time, since the radii of curvature of the ink feeding tube 27, the holding member 28 and the flexible printed wiring board 29 at the curved portion 26*a* differ from each other, the distances among these members vary and hence interference by being in friction with each other may occur.

From this point of view, according to the liquid feeding device 26 in the embodiment, since the binding members 30 bind the ink feeding tube 27, the holding member 28 and the flexible printed wiring board 29 at a plurality of points at regular intervals in the longitudinal direction while maintaining a distance from each other, the ink feeding tube 27 is prevented from being in friction with the holding member 28 and the flexible printed wiring board 29. In addition, since the binding members 30 are fixed to the ink feeding tube 27, the friction between the ink feeding tube 27 and the binding members 30 is also avoided.

Therefore, since generation of chips from the ink feeding tube 27 due to friction with the binding members 30, the holding member 28 and the flexible printed wiring board 29 is restrained, the possibility of dropping of the chips onto the recording paper P during the print job is reduced, and hence the print quality is improved. Furthermore, noise generated when the ink feeding tube 27 is in friction with the binding members 30, the holding member 28 and the flexible printed wiring board 29 (sliding noise) is restrained.

Since the binding members 30 slidably support the holding member 28 and the flexible printed wiring board 29, the movement of the carriage 18 and the change of the shape of the liquid feeding device 26 in association with the movement of the carriage 18 are not hindered.

According to the embodiment described above in detail, the following advantages are achieved.

(1) According to the liquid feeding device 26, since the binding members 30 bind the ink feeding tube 27, the holding member 28 and the flexible printed wiring board 29 while maintaining a distance from each other, the ink feeding tube 27 is restrained from being in friction with the holding member 28 and the flexible printed wiring board 29. In addition, since the binding members 30 are fixed to the ink feeding tube 27, the ink feeding tube 27 is also prevented from being in friction with the binding members 30.

Therefore, since generation of chips from the ink feeding tube 27 due to friction with the binding members 30, the holding member 28 and the flexible printed wiring board 29 is restrained, the possibility of dropping of the chips onto the recording paper P during the print job is reduced, and hence the print quality is improved. Furthermore, noise generated when the ink feeding tube 27 is in friction with the binding members 30, the holding member 28 and the flexible printed wiring board 29 (sliding noise) is restrained.

Since the binding members 30 slidably support the holding member 28 and the flexible printed wiring board 29, the movement of the carriage 18 and the change of the shape of the liquid feeding device 26 in association with the movement of the carriage 18 are not hindered.

(2) According to the liquid feeding device 26, since the binding members 30 are composed of polyamide having a higher abrasion resistance than elastomer which constitutes the ink feeding tube 27, durability of the binding members 30 is improved.

(3) According to the liquid feeding device 26, since the plurality of the binding members 30 are provided along the longitudinal direction of the ink feeding tube 27, the ink feeding tube 27, the holding member 28 and the flexible printed wiring board 29 are bound stably while maintaining a distance from each other.

(4) According to the liquid feeding device 26, since the binding members 30 are arranged at regular intervals, the ink feeding tube 27, the holding member 28 and the flexible printed wiring board 29 are bound stably in a balanced manner while maintaining a distance from each other.

(5) Since the binding members 30 are configured to be attachable to and detachable from the ink feeding tube 27, the position of fixation of the ink feeding tube 27 can be changed easily.

(6) Since the swingable portion 32 is locked in a state in which the both fixing strips 31*a* and the both fixing strips 32*b* are dug into the ink feeding tube 27 when fixing the binding members 30 with respect to the ink feeding tube 27, the binding members 30 may be fixed firmly with respect to the ink feeding tube 27.

Modification

The embodiment shown above may be modified within the scope which provides the above-described advantages.

The position of arrangement of the binding members 30 in the liquid feeding device 26 may be changed as needed according to the circumstances.

The intervals of arrangement of the binding members 30 in the liquid feeding device 26 do not have to be the regular intervals along the longitudinal direction of the ink feeding tube 27.

The number of binding members 30 in the liquid feeding device 26 may be changed as needed according to the circumstances (for example, it may be one).

The width of the binding members 30 (the length of the binding member 30 in the longitudinal direction of the ink feeding tube 27) may be changed as needed according to the circumstances.

In the liquid feeding device 26, the flexible printed wiring board 29 may be arranged outside (front side) of the holding member 28.

The material which constitutes the binding members 30 does not have to be a material having a higher abrasion resistance than elastomer which constitutes the ink feeding tube 27.

In the liquid feeding device 26, the longitudinally extending member which are bound by the binding members 30 together with the ink feeding tube 27 may be one of the holding member 28 and the flexible printed wiring board 29.

In the embodiment shown above, the ink jet printer (printing apparatus including facsimile machines and copying machines) 11 which ejects ink has been described as the liquid ejecting apparatus. However, it may be a liquid ejecting apparatus which ejects other types of liquid. For example, it may be a liquid ejecting apparatus which ejects liquid such as electrode material or coloring material used for manufacturing liquid crystal displays, EL displays and surface emission type displays and so on, a liquid ejecting apparatus which ejects bioorganic substances used for manufacturing biochips or a sample ejection apparatus as an accurate pipette.

What is claimed is:

1. A liquid feeding device comprising:

a flexible tube arranged so as to be curved at the midsection thereof for feeding liquid to a liquid ejecting head that ejects the liquid toward a target;

a flexible printed wiring board arranged so as to extend along the tube; and a binding member for binding the flexible printed wiring board with the tube at a distance from each other to prevent friction between the flexible printed wiring board and the tube, wherein the binding member includes:

a body portion;

a swingable portion which is swingable toward and away from the body portion; and a fixing strip which digs into the tube in a state of fixing the binding member to the tube, and wherein the binding member is fixed to the tube by locking the swingable portion to the body portion in a state of pinching the tube between the body portion and the swingable portion, and wherein the binding member slidably arranges the flexible printed wiring board.

2. The liquid feeding device according to claim 1, wherein the liquid feeding device includes a band-shaped member having resiliency, wherein the flexible printed wiring board is arranged between the body portion and the band-shaped member.

3. The liquid feeding device according to claim 1, wherein a the binding member includes a limiting projection for limiting the movement of the flexible printed wiring board.

4. The liquid feeding device according to claim 1, further comprising a plurality of the binding members provided along the longitudinal direction of the tube, and wherein the binding members are arranged at regular intervals.

5. A liquid ejecting apparatus comprising:

a liquid ejecting head for ejecting liquid toward a target; and a liquid feeding unit for feeding the liquid to the liquid ejecting head, wherein the liquid feeding unit is composed of a liquid feeding device according to claim 1.

* * * * *